United States Patent [19]

Bächtiger

[11] 4,225,377

[45] Sep. 30, 1980

[54] METHOD FOR STIFFENING AND DYEING TEXTILE FABRIC

[75] Inventor: Hans Bächtiger, Stallikon, Switzerland

[73] Assignee: Gygli Technik AG, Zug, Switzerland

[21] Appl. No.: 906,945

[22] Filed: May 16, 1978

[30] Foreign Application Priority Data

May 20, 1977 [CH] Switzerland ..... 6262/77

[51] Int. Cl.[2] ..... D06P 5/00; D06P 7/00; C09J 5/04

[52] U.S. Cl. ..... 156/314; 8/445; 8/478; 8/495; 68/200; 427/289

[58] Field of Search ..... 8/17, 18 R, 181, 62, 8/150; 156/314

[56] References Cited

U.S. PATENT DOCUMENTS

| | | | |
|---|---|---|---|
| 3,967,009 | 6/1976 | Blake | 427/256 |
| 4,148,604 | 4/1979 | Bächtiger | 8/181 |

FOREIGN PATENT DOCUMENTS

| | | |
|---|---|---|
| 2535593 | 2/1976 | Fed. Rep. of Germany . |
| 2720056 | 5/1978 | Fed. Rep. of Germany . |
| 510203 | 7/1939 | United Kingdom . |
| 617167 | 2/1949 | United Kingdom . |
| 911517 | 11/1962 | United Kingdom . |
| 1403852 | 8/1975 | United Kingdom . |
| 1433957 | 4/1976 | United Kingdom . |
| 1517358 | 7/1978 | United Kingdom . |

*Primary Examiner*—A. Lionel Clingman

*Attorney, Agent, or Firm*—Frishauf, Holtz, Goodman & Woodward

[57] ABSTRACT

A stiffening agent is applied in liquid form to the fabric by screen printing. Thereafter the fabric is dried and further treated. The agent is contained above the screen in a sealed container. Means are provided for varying the pressure in the container to thereby vary the flow of the agent through the screen. The container can be compartmentized to provide different flow rates at different locations of the screen. Also, instead of a stiffening agent, there can be printed a dye in a like manner. The dye and stiffening agent can also be printed together in a mixture.

15 Claims, 4 Drawing Figures

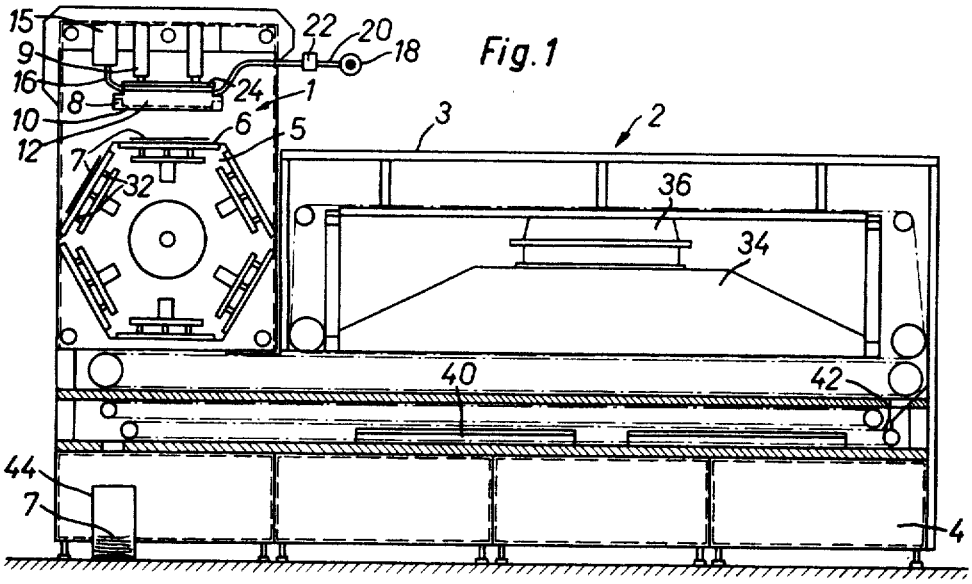
Fig. 1
Fig. 2
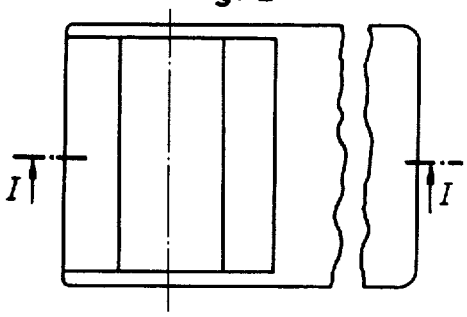
Fig. 3
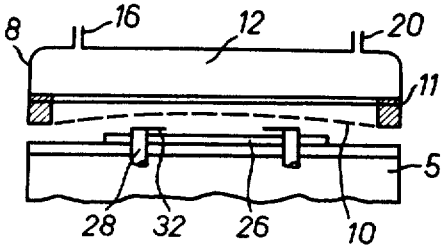
Fig. 4
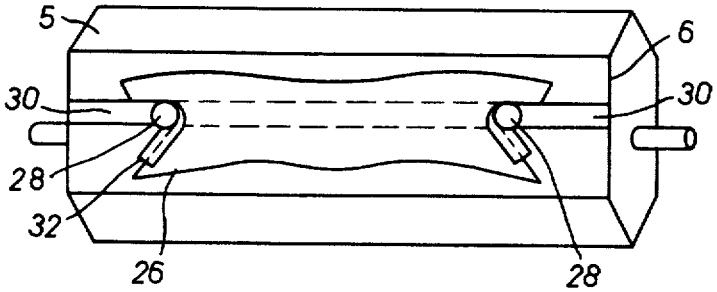

METHOD FOR STIFFENING AND DYEING TEXTILE FABRIC

The present invention relates to a method for stiffening and controlled printing, adhesively coating and joining of textile fabric, by applying a suitable flowable agent by screen printing. The thus treated fabric is dried and subsequently undergoes further treatment.

BACKGROUND AND PRIOR ART

Methods are already known by means of which textile fabrics are stiffened by applying a stiffening agent. According to the method known from Swiss Pat. No. 208 340 (to which British Pat. No. 510,203 corresponds), articles made from flexible fabrics are stiffened by applying a liquid, colourless stiffening agent to the semi-finished or finished articles. Following evaporation of a solvent in the liquid, this stiffening agent must exert no adhesive action on adjacent layers of fabric. The stiffening agent is applied in such a way that a graded stiffness or flexibility is obtained or, alternatively, said stiffness or flexibility varies according to the intended use. This varying degree of stiffness is obtained by covering individual areas of the articles when applying the stiffening agent, by using solutions with different concentrations, or by applying different quantities of stiffening agent, for example by means of spraying nozzles using a different pressure or by partly covering the fabric with wire netting with varying thickness during spraying.

In the method known from British Pat. No. 911 517, a plastic material which can set or be cured under the action of heat is applied to the article in the form of an aqueous dispersion, emulsion or melt. By means of an engraved roller or a hollow screen, the stiffening agent is applied in varying quantities, so that a different degree of stiffening is obtained in individual portions of the article.

The use of known printing processes, e.g. relief, intaglio or screen printing for applying the stiffening agent to the textile fabric is proposed by the method of German Disclosure Document (Offenlegungsschrift) DE-OS No. 25 35 593.

All the printing processes for applying the stiffening agent which are proposed in conjunction with the known methods have disadvantages. Quite apart from the fact that in the known printing processes the time required for applying the stiffening agent is relatively long, it is only possible to a limited extent to adapt the metering to the particular textile fabric to be treated. In addition, the known printing processes are not suitable for processing a stiffening agent which must be drop-forming, and not viscous, in order to flow in a satisfactory manner into the fibres. As a result, the known methods are time-consuming.

THE INVENTION

It is an object to obviate the disadvantages of the known methods, to reduce the printing time for applying the stiffening agent to the textile fabric and to permit the application of any desired stiffening agent metered in a simple manner and in varying thicknesses to different points of the fabric. In in addition, the screen printing form, or stencil, should only be slightly larger than the fabric piece, and mechanical stresses on the screen printing form substantially eliminated.

According to the present invention, textile fabric is placed under a screen printing form, the stiffening agent is distributed over the complete side of the screen printing form which is remote from the textile fabric and its level is kept spaced above the screen printing form. During screen printing the thickness of the stiffening agent applied to the textile fabric is controlled by the pressure acting on the screen printing form.

The invention also relates to an apparatus for performing the method according to the invention in which the textile fabric is placed on a gradually moved substrate over which is guided a container for receiving the stiffening agent vertically towards and away from the substrate. Its base is formed by the screen printing form and its remaining walls are constructed in gas tight manner, a pressure source being connected to the container which permits the adjustment of the pressure in the container.

BRIEF DESCRIPTION OF THE DRAWINGS

The invention is described in detail hereinafter relative to a preferred embodiment and with reference to the drawings which show:

FIG. 1 A side view, partly in section, of a diagrammatically represented apparatus for stiffening a textile fabric. FIG. 2 A plan view of the apparatus according to FIG. 1.

FIG. 3 A vertical section through the screen printing form of the apparatus of FIG. 1 and the printing substrate on an enlarged scale.

FIG. 4 A plan view of the printing substrate of FIG. 3.

DETAILED DESCRIPTION OF THE INVENTION

The invention is based on the consideration that use of a screen printing form, or stencil, although apparently suitable for applying a stiffening agent to a textile fabric, is too restricted in its presently known form, particularly with respect to the choice of stiffening agent. Thus, although the present invention uses a screen printing form for applying the stiffening agent to the textile fabric, printing takes place in a modified manner, as will be described in greater detail hereinafter.

The apparatus for stiffening textile fabric, which is shown in FIG. 1, substantially comprises a printing part 1 in which a stiffening agent is applied to a textile fabric, and a drying and after-treatment part 2. The latter is not related to the invention, so that its construction will only briefly be described. Part 2 could also be realized in some other way, without having any influence on the invention.

The essential components of printing part 1 and drying and after-treatment part 2 are covered by a housing 3 and mounted on a machine frame 4. A supply drum 5 having the shape of a six-sided prism is pivotably mounted on machine frame 4. However, it is also possible to use drums with a different number of sides or in the form of a cylinder. The supply drum 5 can also be replaced by some other conveying mechanism, e.g. a conveyor belt.

The sides 6 of supply drum 5 serve to in each case receive one of the portions to be treated, e.g. inserts for stiffening and shaping items of clothing. In FIG. 1, one side 6 of supply drum 5 with a fabric piece fixed thereto is located directly below a pressure tank or vessel 8 which is guided in vertical manner on a support 9. Pressure tank 8 is constructed in gas tight manner and has on its base a screen printing form 10 which is stretched over a frame 11 fixed to tank 8, e.g. by adhesion.

Screen printing form 10 can be made from a fabric of silk, plastic, bronze or stainless steel or can be in the form of a completely perforated screen. The fabric or screen forming the form 10 is patterned in known manner as a function of the stiffening to be carried out, e.g. by photogravure, and then forms the base of the pressure tank. As a result of the patterning, the application of the stiffening agent takes place at specific points and with a specific metering action.

The stiffening agent, which is relatively viscous, is filed to a particular level into the inner space or chamber 12 defined by pressure tank 8 and is kept at a substantially constant level by a regulating mechanism, e.g. by a float (not further described). Above pressure tank 8 is arranged a storage tank 15 which is connected to pressure tank 8 via a line 16 and a metering device, not shown. Storage tank 15 serves to supply stiffening agent to pressure tank 8 so as to maintain a constant level in the latter. Pressure tank 8 is also connected via a line 20 to a diagrammatically represented pressure source 18. The pressure in the chamber 12 is regulated by means of a diagrammatically represented pressure control system 22.

To enable the pressure tank 8 or the screen printing form 10 arranged on the bottom thereof to be centered precisely with the fabric piece held on the side 6 of supply spool 5, the pressure tank is adjustably mounted in a frame 24 guided on support 9. The adjustability of pressure tank 8 can be achieved for example by means of a cross-table construction such as is used for machine tools.

FIGS. 3 and 4 show that a printing substrate 26 is fixed to side 6 of supply spool 5. To this end, adjustable stops 28 are provided in each side and serve for centering both the printing substrate and the fabric piece. The stops 28 are under the action of a not-shown spring and are displaceable in a gap 30 in side 6. Thus, printing substrate 26 also covers gap 30 in the area of the fabric 7 to be treated. In turn, the fabric 7 is held on the printing substrate 26 by a holding-down device 32, so that after application of the stiffening agent the fabric does not stick to the screen printing form 10.

The drying and after-treatment part 2 comprises a drying mechanism 34, e.g. a drying chamber, to which hot air is supplied by means of a blower 36. The fabric 7, to which stiffening agent has been applied, is fed from supply spool 5 to a conveying mechanism 38 which moves it through the drying chamber 34. After leaving the drying chamber 34, the fabric 7 passes into a condensing section 40, where it is heated to a higher temperature to obtain the desired chemical reaction. The condensing section 40 can also have a conveying mechanism 42 by means of which fabric 7 is passed through the condensing section 40. In place of a linear condensing section 40, it is also possible to use a condensing drum. After leaving condensing section 40, fabric 7 passes into a stacking mechanism 44, from which it is conveyed away for further processing.

Operation:

Supply drum 5 places the fabric 7 applied to sides 6 below pressure tank 8, the latter being lowered until the screen printing form 10 is just above or directly at the level of fabric 7. By correspondingly regulating the pressure in the inner space 12 of pressure tank 8, the screen printing form is lowered onto the fabric 7. If the application of the stiffening agent is to be interrupted, the pressure is again changed, e.g. by setting a vacuum so that the screen printing form 10 is raised into the position shown in FIG. 3. After raising the pressure tank 8, the further operation of supply spool 5 is effected, so that the following fabric is brought below pressure tank 8. The application of the stiffening agent now takes place in precisely the same way as described hereinbefore. The holding-down devices 32 on the bottom of supply spool 5 are opened and the fabric is transferred to the conveying mechanism 38, drying and condensing then taking place in the manner described hereinbefore.

It is essential that the stiffening agent is applied by regulating the pressure in the inner space 12 of pressure tank 8. This eliminates substantially all the restrictions existing with the known printing processes. It is possible to use a relatively viscous stiffening agent and despite this the quantity thereof to be applied can be very accurately metered. Numerous possibilities exist for controlling the application of stiffening agent, such as modifying the passage of the screen printing form, the flow behaviour of the stiffening agent, the magnitude and duration of the pressure and/or vacuum, etc. It would also be possible to apply the stiffening agent by pressure regulation on the back of a porous printing substrate.

In order to permit rapid changing of the screen printing form 10, the stiffening agent can be sucked out of pressure tank 8 by means of a pump, not shown, and can be returned again after applying a new pattern.

When using the apparatus according to the invention, there are no restrictions regarding the use of different stiffening agents. The desired metering can be obtained without difficulty by choosing the most suitable pressure conditions during application of the stiffening agent.

The term textile fabric is understood to mean layers or parts of layers or punched out parts of knitted, woven or non-woven fabrics.

The products suitable for stiffening and dimensional stabilisation are those which under suitable conditions can form a chemical bond with the fabric material used, with other products applied to the fabric, or with one another, while being able to maintain the fabric dimensions stable during the reaction. For this purpose it is possible to use the conventional products of the textile industry, e.g. urea-formaldehyde precondensates; melamine compounds; carbamides; acetals; compounds of the ethylene urea, dihydroxydiethylene urea and dihydroxydimethyl diethylene urea types and all homologs thereof; and, similar substances either alone or in combination with other mentioned products and/or in combination with a suitable catalyst. It is possible to use as the catalyst organic or inorganic acids or metal salts of an organic or inorganic acid, such as e.g. alkali metal or earth, alkaline halide, or an ammonium salt. It is also possible to use other products, such as e.g. monomers which can be reacted with the fabric material or with themselves, accompanied by a condensation or polycondensation, addition or polyaddition, or polymerisation, or other chemical reactions taking place with or without the splitting off of a further reaction product, examples being styrene, ethylene, proplylene and the like.

The described process can be applied not only to the stiffening treatment of textile fabric, but can also in fact be combined with other treatments. It can be used advantageously for producing inserts, required e.g. in the manufacture of shirts and other items of clothing. These inserts are either stiffened uniformly over their entire surface or are stiffened to a differing degree, for which purpose the above-described process is also suitable. Following stiffening, said inserts are generally connected in suitable manner with an upper material, for which purpose direct adhesion of the insert to the upper material by means of thermoplastic adhesives with which e.g. one side of the substrate is coated has proved advantageously suitable. Obviously, coating can also take place on the upper material. Independently of the point of application, coating takes place at discrete points or over larger areas. The actual adhesion is accompanied by pressure and heat application, for which purpose generally special bonding presses are used.

The described stiffening process can be extended in such a way that lightly attached or loosely applied fabrics, e.g. an upper material and inserts, are stiffened together with the above-mentioned stiffening process. The stiffening agent must be dried and condensed in a condensing section. The condensing section can easily be constructed in such a way that adhesion of the fabric takes place simultaneously with the condensing of the stiffening agent. Advantageously the condensing section is constructed as a heating drum over which the fabric is guided and simultaneously pressed.

In the case of fine upper materials, it is impossible to prevent the color of the materials used for the inserts showing through. Therefore, it has proved necessary to maintain large stocks of materials with very varied colors, so that an insert or lining of the correct color is available. This disadvantage can be obviated in a very simple manner through admixing of suitable dye components with the stiffening agent. Thus, a dye treatment takes place simultaneously with the stiffening treatment in the case of the stiffening method according to the invention.

If, in the case of inserts, only certain areas are to be stiffened, by suitable choice of dye components it is possible to dye only the stiffened areas. It is also possible to add to the stiffening agent dye components which do not adhere to the latter and instead flow out of the same, thereby dyeing the whole area of the insert. However, dyeing can also be performed in a separate working step. The above-indicated process can also be used for dyeing purposes alone. The stiffening agent is replaced by the dye which is applied to the screen printing form in the pressure tank. After dyeing of the whole area of the insert, still without a stiffening agent, the substrate can be stiffened. The whole area or only parts thereof can be stiffened, as desired. As the process is based on a pressure action of the screen printing form, making the use of a doctor blade unnecessary, the form can be sub-divided into different areas. On the side remote from the printing substrate it is possible to apply different colors, so that the inserts are printed simultaneously in multicolored form. If printing takes place simultaneously with the stiffening treatment, different degrees of stiffness can be obtained in the different area portions. Thus, inserts can be produced in this way whose area portions are on the one hand only printed with color and on the other are stiffened with dye-containing stiffening agents. The different treatment of the area portions takes place in one and the same working operation.

As has already been stated, the above-described stiffening process can be extended so as to coat in punctiform manner textile fabrics with thermoplastic adhesives, such as are e.g. conventional with directly adherable inserts. All that is necessary in a corresponding screen printing form. The adhesive is applied to the side of the screen printing form remote from the fabric in the pressure tank. Coating takes place in exactly the same way as in the stiffening process by controlling the pressure action.

Coating with the above-indicated adhesives can take place before or after the dyeing or stiffening treatment, or the simultaneous dyeing and stiffening can take place in a separate operation or continuously at an additional printing station. Coating can thereby take place on one or both sides and over all or part of the total area. It is also possible without difficulty to coat all of one side and only certain areas of the other side. Due to the fact that the thermoplastic discrete point application of the coating with the described process can be distributed in any desired manner over the fabric, a varying stiffness distribution over the fabric is obtained.

As a result of the above-described extension of the stiffening process, the production of stiffened inserts and their use in conjunction with upper materials is further simplified. A considerable time-saving and reduction of stocks are possible.

I claim:

1. In a method for stiffening and additionally further treating textile fabric by applying a flowable stiffening agent to the fabric by means of screen printing, after which the fabric is dried, and utilizing the steps of providing a pressure tank or vessel (8) having a screen printing form (10) forming one wall thereof;

locating said fabric (7) adjacent one side of the screen printing form with a surface thereof facing the screen printing form;

introducing a stiffening agent into the vessel (8) and distributing said stiffening agent over the whole side of the screen printing form remote from the textile fabric;

maintaining the level of stiffening agent spaced over the screen printing form;

screen printing the stiffening agent onto the fabric by applying controlled fluid pressure to the stiffening agent to thereby control the thickness of the stiffening agent coating applied to the textile fabric by control of the pressure of the stiffening agent passing through the screen printing form;

and comprising, in accordance with the improvement, the step of introducing a dye into the vessel;

and screen printing the fabric with the dye by applying controlled fluid pressure to the dye in the vessel (8) to control application of the dye to the fabric.

2. The method according to claim 1, wherein the step of dye-treating comprises screen printing the dye onto only certain predetermined selected area portions of the textile fabric.

3. The method according to claim 1, wherein the step of screen printing onto the fabric comprises applying the dye in only those area portions to the fabric where stiffening agent is applied to the fabric.

4. The method according to claim 1, wherein the step of screen printing onto the fabric comprises the step of applying the dye in area portions of the textile fabric different from area portions where stiffening agent is being screen printed onto the fabric.

5. The method according to claim 1, wherein the step of screen printing the stiffening agent onto the fabric and the step of dye treatment are combined and the step of introducing the stiffening agent into the vessel includes the step of mixing a dye with the stiffening agent.

6. Method of dyeing textile fabric by applying a flowable dye to the fabric comprising the steps of providing a pressure vessel (8) having a screen printing form (10) forming one wall thereof;

locating said fabric (7) adjacent one side of the screen printing form, with the surface to be printed facing the screen printing form;

introducing a flowable liquid dye into the vessel, and hence on the other side of the screen printing form;

distributing the dye over the side of the screen printing form remote from the textile fabric;

maintaining the level of the dye in the pressure vessel spaced from the screen printing form;

screen printing the dye onto the fabric by applying controlled fluid pressure to the dye in the pressure vessel to thereby control the thickness of application of the dye coating applied to the textile fabric by control of the pressure of the dye passing through the screen printing form.

7. Method according to claim 6, including the further step of stiffening the fabric after having been printed over its whole area.

8. Method according to claim 6, wherein the step of screen printing the dye onto the fabric comprises screen printing selected area portions of the fabric with dyes of different colors.

9. Method according to claim 8, including the further step of stiffening selected portions of the fabric after having been selectively differently color-printed.

10. In a method for stiffening and additionally further treating textile fabrics by applying a flowable stiffening agent to the fabric by means of screen printing, after which the fabric is dried, and utilizing the steps of providing a pressure tank or vessel (8) having a screen printing form (10) forming one wall thereof;

locating said fabric (7) adjacent one side of the screen printing form with a surface thereof facing the screen printing form;

introducing a stiffening agent into the vessel (10) and distributing said stiffening agent over the whole side of the screen printing form remote from the textile fabric;

maintaining the level of stiffening agent spaced over the screen printing form;

screen printing the stiffening agent onto the fabric by applying controlled fluid pressure to the stiffening agent to thereby control the thickness of the stiffening agent coating applied to the textile fabric by control of the pressure of the stiffening agent passing through the screen printing form;

and comprising, in accordance with the improvement, the step of introducing a thermoplastic adhesive into the vessel;

and applying said thermoplastic adhesive to the fabric having the stiffening agent applied thereto by applying controlled fluid pressure to the adhesive in the vessel (8) to control application of the adhesive to the fabric.

11. Method according to claim 10, including the step of applying a further layer of fabric over the textile fabric material;

and heat treating the textile material to set the stiffening agent and the adhesive.

12. Method according to claim 11, wherein the heat treatment step comprises drying and condensing the stiffening agent and the adhesive in a condensing section.

13. Method according to claim 1, wherein the step of applying controlled fluid pressure comprises applying pneumatic pressure to the interior (12) of said vessel (8).

14. Method according to claim 6, wherein the step of applying controlled fluid pressure comprises applying pneumatic pressure to the interior (12) of said vessel (8).

15. Method according to claim 10, wherein the step of applying controlled fluid pressure comprises applying pneumatic pressure to the interior (12) of said vessel (8).

* * * * *